US012252853B2

(12) United States Patent
Kovalick et al.

(10) Patent No.: US 12,252,853 B2
(45) Date of Patent: Mar. 18, 2025

(54) CYLINDER SEQUENCING FOR A DUAL STAGE LIFT SYSTEM FOR A SNOW WING

(71) Applicant: Caterpillar Inc., Peoria, IL (US)

(72) Inventors: Benjamin J. Kovalick, Chillicothe, IL (US); Bruce Raymond Vahling, Urbana, IL (US); Ernest Everett Stoops, Mt. Zion, IL (US)

(73) Assignee: Caterpillar Inc., Peoria, IL (US)

( * ) Notice: Subject to any disclaimer, the term of this patent is extended or adjusted under 35 U.S.C. 154(b) by 613 days.

(21) Appl. No.: 17/651,333

(22) Filed: Feb. 16, 2022

(65) Prior Publication Data

US 2023/0257951 A1 Aug. 17, 2023

(51) Int. Cl.

| | |
|---|---|
| ***E01H 5/06*** | (2006.01) |
| ***E02F 3/84*** | (2006.01) |
| ***E02F 3/96*** | (2006.01) |

(52) U.S. Cl.

CPC ..... *E01H 5/067* (2013.01); *E02F 3/844* (2013.01); *E02F 3/961* (2013.01)

(58) Field of Classification Search

CPC ..... E01H 5/061; E01H 5/063; E01H 5/067; E02F 3/844; E02F 3/961

See application file for complete search history.

(56) References Cited

U.S. PATENT DOCUMENTS

| | | | | |
|---|---|---|---|---|
| 3,659,363 | A | 5/1972 | Snyder | |
| 3,851,710 | A | 12/1974 | Grimm | |
| 4,045,892 | A | 9/1977 | Farrell | |
| 4,096,652 | A * | 6/1978 | Raines | E01H 5/063 37/231 |
| 5,860,230 | A | 1/1999 | Daniels | |
| 6,249,992 | B1 | 6/2001 | Irving et al. | |
| 6,296,081 | B1 | 10/2001 | Nagai et al. | |
| 6,442,877 | B1 | 9/2002 | Quenzi et al. | |
| 6,581,307 | B1 | 6/2003 | Jones et al. | |
| 6,941,686 | B2 | 9/2005 | Cusick | |
| 7,134,227 | B2 | 11/2006 | Quenzi et al. | |
| 7,263,789 | B2 | 9/2007 | Hollinrake et al. | |
| 8,776,406 | B2 | 7/2014 | Stephan | |
| 8,777,545 | B2 | 7/2014 | Roux | |

(Continued)

FOREIGN PATENT DOCUMENTS

| | | |
|---|---|---|
| CA | 2703392 C | 7/2012 |
| GB | 1488015 A | 10/1977 |

*Primary Examiner* — Thomas B Will
*Assistant Examiner* — Robert E Pezzuto

(57) ABSTRACT

In some implementations a lift assembly for a snow wing assembly may include a first lifting mechanism, coupled to the motor grader, configured to lift the snow wing assembly a first portion of a bench height associated with a moldboard via a first hydraulic cylinder. The lift assembly may include a second lifting mechanism, coupled to the first lifting mechanism and the moldboard, configured to lift the moldboard of the snow wing assembly a second portion of the bench height via a second hydraulic cylinder. The lift assembly may include one or more valves included in a hydraulic circuit of the first hydraulic cylinder and the second hydraulic cylinder, configured to divert a flow of hydraulic fluid in the hydraulic circuit away from a first stage hydraulic cylinder and to a second stage hydraulic cylinder, based on a pressure value associated with the first stage hydraulic cylinder.

20 Claims, 8 Drawing Sheets

(56) References Cited

U.S. PATENT DOCUMENTS

| | | | |
|---|---|---|---|
| 9,303,377 | B2 | 4/2016 | May et al. |
| 9,353,495 | B2 | 5/2016 | Becicka et al. |
| 9,752,293 | B2 | 9/2017 | Dubiel et al. |
| 10,053,826 | B1 | 8/2018 | Null et al. |
| 10,113,283 | B1 | 10/2018 | Jones |
| 10,316,480 | B2 | 6/2019 | Kemmerling et al. |
| 10,370,811 | B2 * | 8/2019 | May ..... E01H 5/067 |
| 10,480,141 | B1 | 11/2019 | Null et al. |
| 2016/0273176 | A1 | 9/2016 | Becicka et al. |
| 2020/0354910 | A1 | 11/2020 | Niemela et al. |

* cited by examiner

CYLINDER SEQUENCING FOR A DUAL STAGE LIFT SYSTEM FOR A SNOW WING

TECHNICAL FIELD

The present disclosure relates generally to lift systems for a snow wing of a machine and, for example, to cylinder sequencing for a dual stage lift system for the snow wing.

BACKGROUND

Machines, such as motor graders (e.g., grader machines), may use a snow wing (e.g., often including a moldboard or other snow blade) to displace, move, distribute, and/or grade snow and/or other material. The snow wing may need to be moved to various positions relative to a work surface and/or the motor grader to effectively carry out one or more of the functions described above and/or to enable other operations of the motor grader. For example, the snow wing may be mounted on a side of a cab of the motor grader and may need to be raised, relative to the ground, to performing a benching operation.

In some cases, a lift assembly of the motor grader may utilize multiple cylinders (e.g., hydraulic cylinders) to raise and/or lower the snow wing to a bench height. However, motor graders may include various systems, components, or tools that utilize cylinders (e.g., hydraulic cylinders) or other hydraulic components. As a result, the motor grader may have limited capacity for additional hydraulic fluid lines and/or circuits. Additionally, the motor grader may have limited capacity for commands for hydraulic components in an operator cab of the motor grader. Therefore, the motor grader may be unable to support multiple cylinders (e.g., hydraulic cylinders) and/or including multiple cylinders in a lift assembly to raise and/or lower the snow wing to a bench height may result in the motor grader being unable to support other hydraulic systems. Moreover, it may be difficult to ensure a correct sequencing of the multiple cylinders (e.g., hydraulic cylinders) without including additional input components in the operator cab of the motor grader.

The lift assembly of the present disclosure solves one or more of the problems set forth above and/or other problems in the art.

SUMMARY

In some implementations, a lift assembly for a snow wing assembly of a motor grader includes a first lifting mechanism coupled to an undercarriage assembly of the motor grader, wherein the first lifting mechanism is configured to lift a moldboard of the snow wing assembly a first portion of a bench height associated with the moldboard via a first hydraulic cylinder; a second lifting mechanism coupled to the first lifting mechanism and the moldboard, wherein the second lifting mechanism is configured to lift the moldboard of the snow wing assembly a second portion of the bench height via a second hydraulic cylinder, wherein the first hydraulic cylinder and the second hydraulic cylinder are included in a hydraulic circuit; and one or more valves included in the hydraulic circuit, configured to divert a flow of hydraulic fluid in the hydraulic circuit away from a first stage hydraulic cylinder, wherein the first stage hydraulic cylinder is one of the first hydraulic cylinder or the second hydraulic cylinder, and to a second stage hydraulic cylinder, wherein the second stage hydraulic cylinder is the other one of the first hydraulic cylinder or the second hydraulic cylinder, based on a pressure value associated with the first stage hydraulic cylinder satisfying a threshold.

In some implementations, a motor grader includes a snow wing assembly, including a moldboard, mounted to the motor grader; and a lifting assembly for the snow wing assembly, configured to lift the moldboard to a bench height, wherein the lifting assembly is coupled to the motor grader and the snow wing assembly, and wherein the lifting assembly includes: a four-bar linkage, coupled to the motor grader, including a first hydraulic cylinder that is configured to lift the moldboard a first portion of the bench height; a lifting mechanism, coupled to an outboard link of the four-bar linkage, including a second hydraulic cylinder that is configured to lift the moldboard a second portion of the bench height, wherein the first hydraulic cylinder and the second hydraulic cylinder are included in a hydraulic circuit; and one or more hydraulic fluid diverters configured to divert a flow of hydraulic fluid in the hydraulic circuit away from a first stage hydraulic cylinder, wherein the first stage hydraulic cylinder is one of the first hydraulic cylinder or the second hydraulic cylinder, and to a second stage hydraulic cylinder, wherein the second stage hydraulic cylinder is the other one of the first hydraulic cylinder or the second hydraulic cylinder, based on a pressure value associated with the first stage hydraulic cylinder.

In some implementations, a method for sequencing a first stage hydraulic cylinder and a second stage hydraulic cylinder of a lifting assembly of a snow wing includes causing hydraulic fluid of a hydraulic circuit to flow to the first stage hydraulic cylinder to cause a moldboard of the snow wing to be moved a first portion of a bench height associated with the moldboard; detecting that the first stage hydraulic cylinder has moved the moldboard the first portion of the bench height based on a pressure value associated with the first stage hydraulic cylinder; and causing, via a pressure relief valve, the hydraulic fluid of the hydraulic circuit to be diverted away from the first stage hydraulic cylinder and to the second stage hydraulic cylinder to cause the second stage hydraulic cylinder to move the moldboard a second portion of the bench height based on detecting that the first stage hydraulic cylinder has moved the moldboard the first portion of the bench height.

DETAILED DESCRIPTION

Reference will now be made in detail to specific embodiments or features, examples of which are illustrated in the accompanying drawings. Generally, corresponding reference numbers will be used throughout the drawings to refer to the same or corresponding parts.

This disclosure relates to a lift system for a snow wing, which is applicable to any machine that includes a mounted snow wing. For example, the machine may be a grader machine (e.g., a motor grader), a plow truck, a dump truck, a dozer, a backhoe loader, a tractor, an excavator, or another vehicle. In other words, although examples are described herein in connection with a motor grader, the hinge and/or coupling system described herein may be similarly applied to any machine that includes a mounted snow wing.

Figure 1:
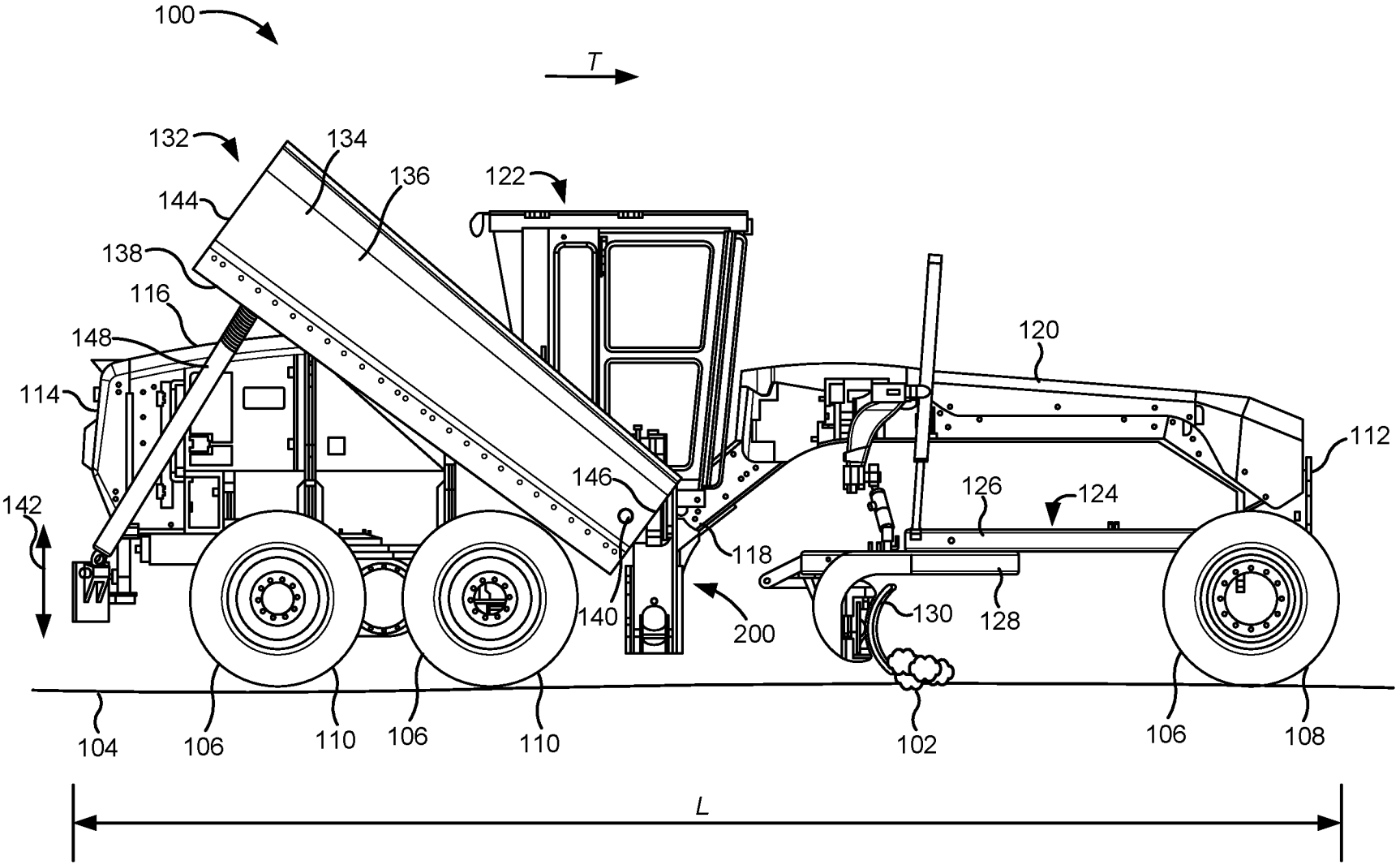
FIG. 1 is a side view of a motor grader described herein.

FIG. 1 is a side view of a motor grader 100 described herein. The motor grader 100 may also be referred to as a grader machine, among other examples. The motor grader 100 may be used to displace, spread, distribute, level, and grade, materials 102, such as snow or soil, over a work surface 104. Generally, a grading operation is performed during machine movement, and for this purpose, the motor grader 100 may include traction devices 106 that facilitate machine movement over the work surface 104. For example, traction devices 106 may include a set of front wheels 108 disposed toward a front end 112 of the motor grader 100 and a set of rear wheels 110 disposed toward a rear end 114 of the motor grader 100. The terms "front" and "rear", as used herein, are in relation to an exemplary direction of travel of the motor grader 100, as represented by arrow, T, in FIG. 1, with the direction of travel being exemplarily defined from the rear end 114 toward the front end 112. The motor grader 100 defines a length, L, between the front end 112 and the rear end 114.

A movement of the traction devices 106 (e.g., a rotation of the set of front wheels 108 and the set of rear wheels 110) may be powered by a power source, such as an engine (not shown in FIG. 1), housed in a power compartment 116 of the motor grader 100. Further, the motor grader 100 may include a main frame portion 118 and a sub-frame portion 120. The main frame portion 118 may also be referred to herein as an undercarriage assembly of the motor grader 100. The sub-frame portion 120 may be movable relative to the main frame portion 118. Further, the motor grader 100 may include an operator cab 122 supported on the sub-frame portion 120. The operator cab 122 may house various controls of the power source and other functions of the motor grader 100.

To grade and level the materials 102, the motor grader 100 may include a drawbar-circle-blade (DCB) arrangement or a drawbar-circle-moldboard (DCM) arrangement, which may also be referred to as a grader group 124. The grader group 124 may be supported by the sub-frame portion 120, and may include a drawbar 126, a circle member 128, and a blade 130 (referred to as a moldboard), each of which may function in concert to perform a grading operation on the work surface 104.

As shown in FIG. 1, the motor grader 100 may also include a snow wing assembly 132 mounted on the motor grader 100. For example, the snow wing assembly 132 may be mounted to the main frame portion 118. The snow wing assembly 132 may be mounted on a side of the motor grader 100 (e.g., on a side of the operator cab 122). For example, as shown in FIG. 1, the snow wing assembly 132 may be mounted on the right hand side of the operator cab 122 relative to the direction of travel T. In other examples, the snow wing assembly 132 may be mounted on the left hand side of the operator cab 122 relative to the direction of travel T. The snow wing assembly 132 may include a moldboard 134. The moldboard 134 may also be referred to as a blade, a plow, and/or a snowplow, among other examples. The moldboard 134 may include a surface 136, such as a curved surface or a concave surface, that may help receive and agglomerate the materials 102 over the work surface 104. As an example, the moldboard 134 may define an edge 138 at a bottom end (e.g., closer to the work surface 104) of the surface 136 to help engage and scrape the materials 102 off the work surface 104 and distribute, level, and grade the work surface 104, during a grading operation.

The snow wing assembly 132 may be mounted to the motor grader 100 via a lift assembly 200 (e.g., also referred to herein as a lifting assembly). The lift assembly 200 may be coupled to the motor grader 100 (e.g., via the main frame portion 118). The lift assembly 200 may be configured to link the snow wing assembly 132 to an undercarriage assembly (e.g., the main frame portion 118) of the motor grader 100. The lift assembly 200 may include one or more lifting mechanisms, such as one or more actuators (e.g., hydraulic actuators and/or pneumatic actuators) and/or other components configured to raise and/or lower the snow wing assembly along a direction 142.

The snow wing assembly 132 may enable the motor grader 100 to perform a benching application, which may involve grading and/or distributing materials 102 from an elevated surface (e.g., elevated relative to the work surface 104). For example, the moldboard 134 may be used to remove, grade, or distribute snow from a top portion of a bank. The moldboard 134 may include an outboard end 144 and an inboard end 146. "Outboard" and "inboard" may be relative to the motor grader 100 and/or the operator cab 122. As shown in FIG. 1, the snow wing assembly 132 may be coupled to the lift assembly 200 proximate to the inboard end 146 of the moldboard 134. In other words, the moldboard 134 may be coupled to the lift assembly 200 proximate to one of the short edges (e.g., at the outboard end 144 and the inboard end 146) of the moldboard 134.

The snow wing assembly 132 may be coupled to the lift assembly 200 via a coupling assembly 140. The coupling assembly 140 may enable the snow wing assembly 132 to rotate in multiple rotational directions. For example, the coupling assembly 140 may enable the snow wing assembly 132 (e.g., and the moldboard 134) to rotate in a first rotational direction (e.g., about a rotational axis defined by a pin of the coupling assembly 140). For example, the snow wing assembly 132 may include an actuator 148, such as a hydraulic actuator or a pneumatic actuator, among other examples, configured to rotate the moldboard 134.

As used herein, "actuator" or "cylinder" may refer to a hydraulic cylinder, a hydraulic actuator, a pneumatic cylinder, a pneumatic actuator, rod-style cylinders, and/or welded body cylinders, among other examples. For example, the lift assembly 140 may utilize a fluid system, such as a hydraulic system, to power one or more components of the lift assembly 140. The fluid system may include one or more actuators or cylinders. For example, the lift assembly 140 may include one or more hydraulic cylinders. The hydraulic cylinder(s) may be single-acting cylinders, double-acting cylinders, tie-rod cylinders, welded rod cylinders, and/or telescopic cylinders, among other examples. The hydraulic cylinder(s) may be internal valve cylinders (e.g., where a control valve is included internally in the cylinder) or external valve cylinders (e.g., where the control value is external to the cylinder). In examples where the lift assembly 140 includes multiple cylinders or actuators, the multiple cylinders or actuators may be included in a single circuit or fluid line, may be included in in separate circuits or fluid lines, may be plumbed in series with one another, and/or may be plumbed in parallel with one another.

As indicated above, FIG. 1 is provided as an example. Other examples may differ from what is described with regard to FIG. 1.

Figure 2:
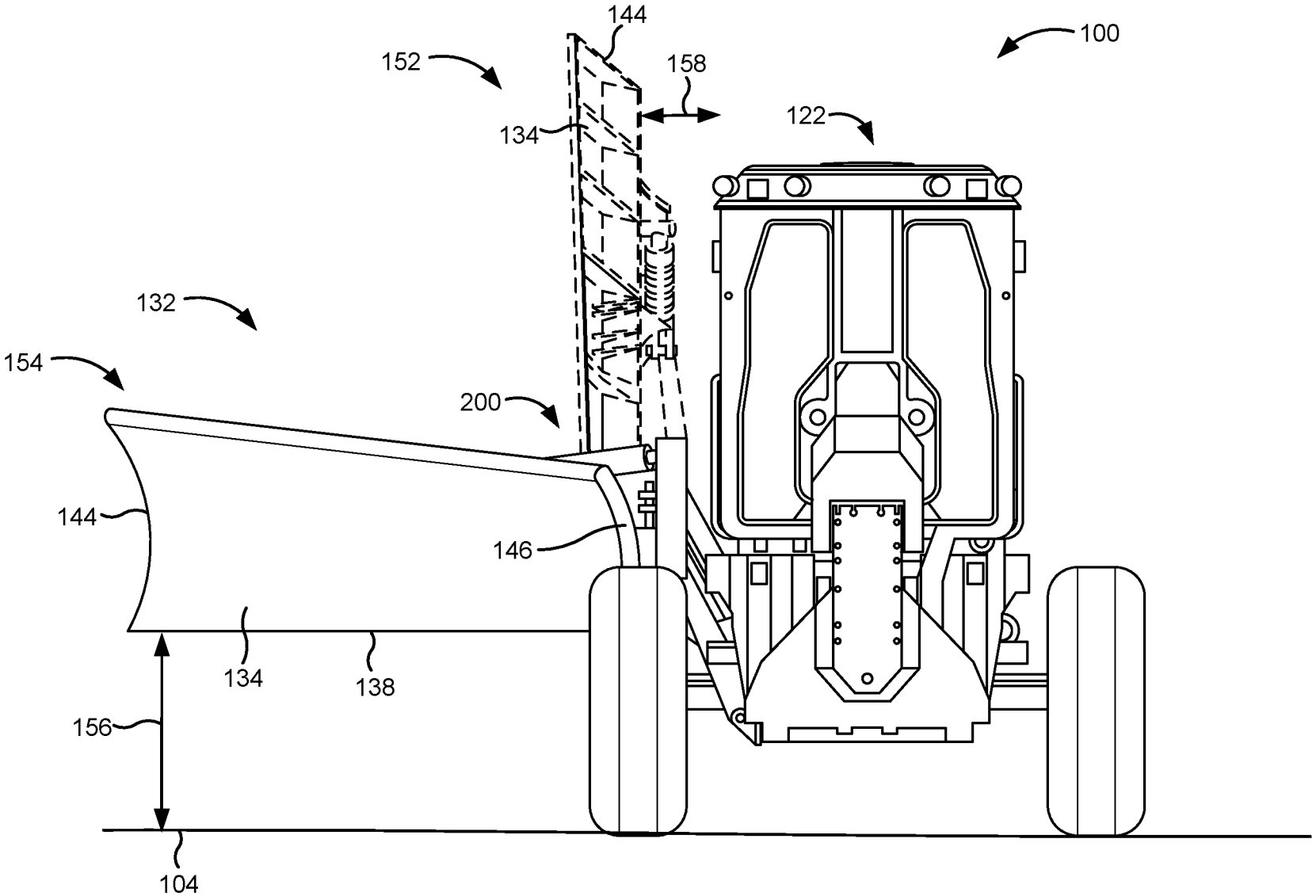
FIG. 2 is a front view of the motor grader described herein.

FIG. 2 is a front view of the motor grader 100 described herein. FIG. 2 depicts the snow wing assembly 132 in various operational positions (e.g., the motor grader 100 depicted in FIG. 2 may include only a single snow wing assembly 132, but FIG. 2 depicts the snow wing assembly 132 in different positions). For example, in a stored state 152, the snow wing assembly 132 may be rotated, in the second rotational direction, with the outboard end 144 of the moldboard 134 rotated proximate to the operator cab 122). In an operational state 154, the snow wing assembly 132 may be rotated, in the second rotational direction, with the outboard end 144 of the moldboard 134 rotated away from the operator cab 122.

As shown in FIG. 2, the snow wing assembly 132 may be associated with a bench height 156. The bench height 156 may be an achievable distance that the lift assembly 200 is capable of raising the snow wing assembly 132 (e.g., the moldboard 134) from a work surface (e.g., the work surface 104) associated with the motor grader 100. For example, the bench height 156 may be measured from the ground to the edge 138 of the moldboard 134. The bench height 156 may be a maximum height that the lift assembly 200 is capable of lifting the snow wing assembly 132 (e.g., the moldboard 134) from the ground. In some examples, the bench height 156 may be greater than 40 inches. More specifically, the bench height 156 may be greater than 50 inches. In some examples, the bench height 156 may be approximately 60 inches.

When the snow wing assembly 132 is raised to the bench height 156, the snow wing assembly 132 (e.g., the moldboard 134) may be a distance 158 from the operator cab 122. For example, as the lift assembly 200 raises the snow wing assembly 132, the lift assembly 200 may cause the snow wing assembly 132 to be pulled closer to the operator cab 122. In other words, when the lift assembly 200 lowers the snow wing assembly 132 to the ground (e.g., to the work surface 104), the lift assembly 200 may cause the snow wing assembly 132 (e.g., the inboard end 146 of the moldboard 134) to be pushed further away from the operator cab 122 than when the snow wing assembly 132 is raised to the bench height 156. The distance 158 may be measured between the inboard end 146 of the moldboard 134 and a side (e.g., a door) of the operator cab 122 on which the snow wing assembly 132 is mounted.

As indicated above, FIG. 2 is provided as an example. Other examples may differ from what is described with regard to FIG. 2.

Figure 3:
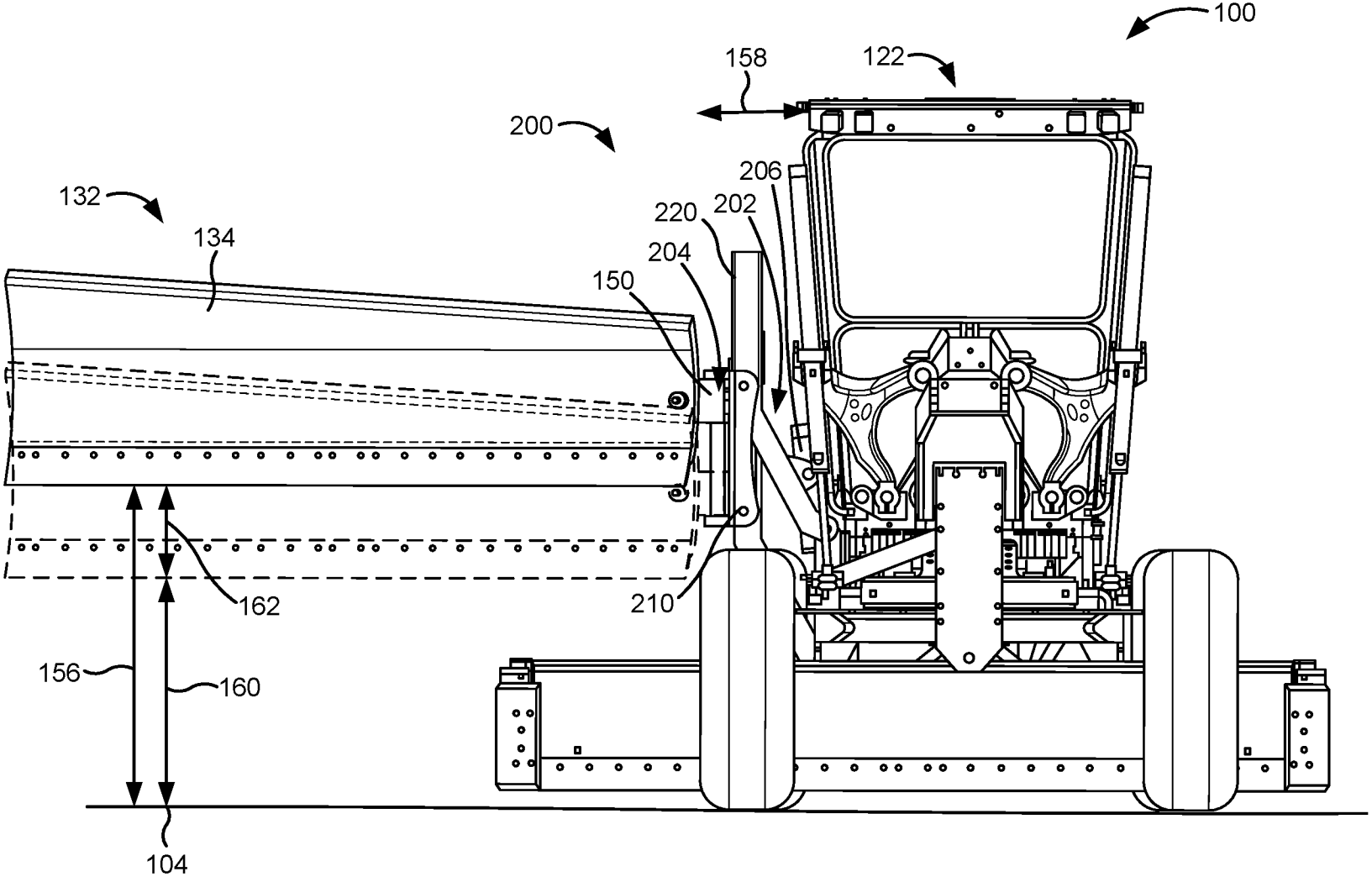
FIG. 3 is a front view of the motor grader and a lift assembly described herein.

FIG. 3 is a front view of the motor grader 100 and the lift assembly 200 described herein. The lift assembly 200 may include a first lifting mechanism 202 and a second lifting mechanism 204. The first lifting mechanism 202 may be mechanically coupled to an undercarriage assembly (e.g., the main frame portion 118) of the motor grader 100. The second lifting mechanism may be mechanically coupled to the first lifting mechanism 202 and the moldboard 134.

The first lifting mechanism 202 may be configured to lift (e.g., raise and/or lower) the moldboard 134 of the snow wing assembly 132 a first portion 160 of the bench height 156 associated with the moldboard 134. The second lifting mechanism 204 may be configured to lift (e.g., raise and/or lower) the moldboard 134 of the snow wing assembly 132 a second portion 162 of the bench height 156 associated with the moldboard 134. In some examples, the first portion 160 may be approximately 75% of the bench height 156 and the second portion 162 may be approximately 25% of the bench height 156. In other examples, the first portion 160 and the second portion 162 may be different percentages of the bench height 156. In other words, the first lifting mechanism 202 may be configured to lift (e.g., raise and/or lower) the moldboard 134 of the snow wing assembly 132 to the first portion 160 of the bench height 156 and the second lifting mechanism 204 may be configured to lift (e.g., raise and/or lower) the moldboard 134 of the snow wing assembly 132 the remainder (e.g., the second portion 162) of the bench height 156. In this way, the lift assembly 200 may be a dual stage lift assembly (e.g., with a first stage being associated with the first lifting mechanism 202 and a second stage being associated with the second lifting mechanism 204).

The first lifting mechanism 202 may include a four-bar linkage configured to lift the moldboard 134 via a hydraulic cylinder 206 associated with the four-bar linkage. The four-bar linkage may include a first vertical member 208, a second vertical member 210, a first horizontal member 212, and a second horizontal member 214 (all depicted in FIG. 4). "Vertical" and "horizontal" are provided for ease of description and are not intended to describe an orientation of the members of the four-bar linkage (e.g., the orientation of the members of the four-bar linkage may change as the four-bar linkage moves). The first vertical member 208 may be coupled to the undercarriage assembler of the motor grader 100. The hydraulic cylinder 206 may be coupled to the first vertical member 208 and the first horizontal member 212 such that when the hydraulic cylinder 206 extends a rod of the hydraulic cylinder 206, the four-bar linkage causes the second vertical member 210 to be raised (e.g., because the first vertical member 208 is fixed in position). The second vertical member 210 may be referred to herein as an outboard link of the four-bar linkage.

The second lifting mechanism 204 may be disposed at, or near, the second vertical member 210 of the four-bar linkage (e.g., of the first lifting mechanism 202). For example, as shown in FIG. 3, the second lifting mechanism 204 may include the hinge 150 slidably coupled to a bar 216. The hinge 150 may be coupled to the moldboard 134. The second lifting mechanism 204 may be configured to cause the hinge 150 to slide along the bar 216. The second lifting mechanism 204 may include an actuator, a hydraulic cylinder, one or more chains, one or more gear systems, a motor, and/or a cable and pulley system, among other examples.

The lift assembly 200 may be configured to raise and/or lower the snow wing assembly 132 and/or the moldboard 134 as described in more detail herein. For example, the first lifting mechanism 202 and the second lifting mechanism 204 may enable the lift assembly 200 to raise the moldboard 134 to a bench height (e.g., the bench height 156) that is greater than or equal to a first threshold distance (e.g., 40 inches, 48 inches, 50 inches, 60 inches, or another distance) and to ensure that a distance (e.g., the distance 158) between the moldboard 134 (e.g., the inboard end 146) and the operator cab 122 of the motor grader is less than a second threshold distance. In other words, the dual stage system of the lift assembly 200 may enable the lift assembly 200 to raise the moldboard 134 to a bench height (e.g., the bench height 156) that is greater than or equal to a first threshold distance while also ensuring that the distance (e.g., the distance 158) between the moldboard 134 (e.g., the inboard end 146) and the operator cab 122 is not too large so as to cause collisions with nearby objects when the moldboard 134 is raised to the bench height 156 and/or when the snow wing assembly 132 is in the stored state 152.

As indicated above, FIG. 3 is provided as an example. Other examples may differ from what is described with regard to FIG. 3.

Figure 4:
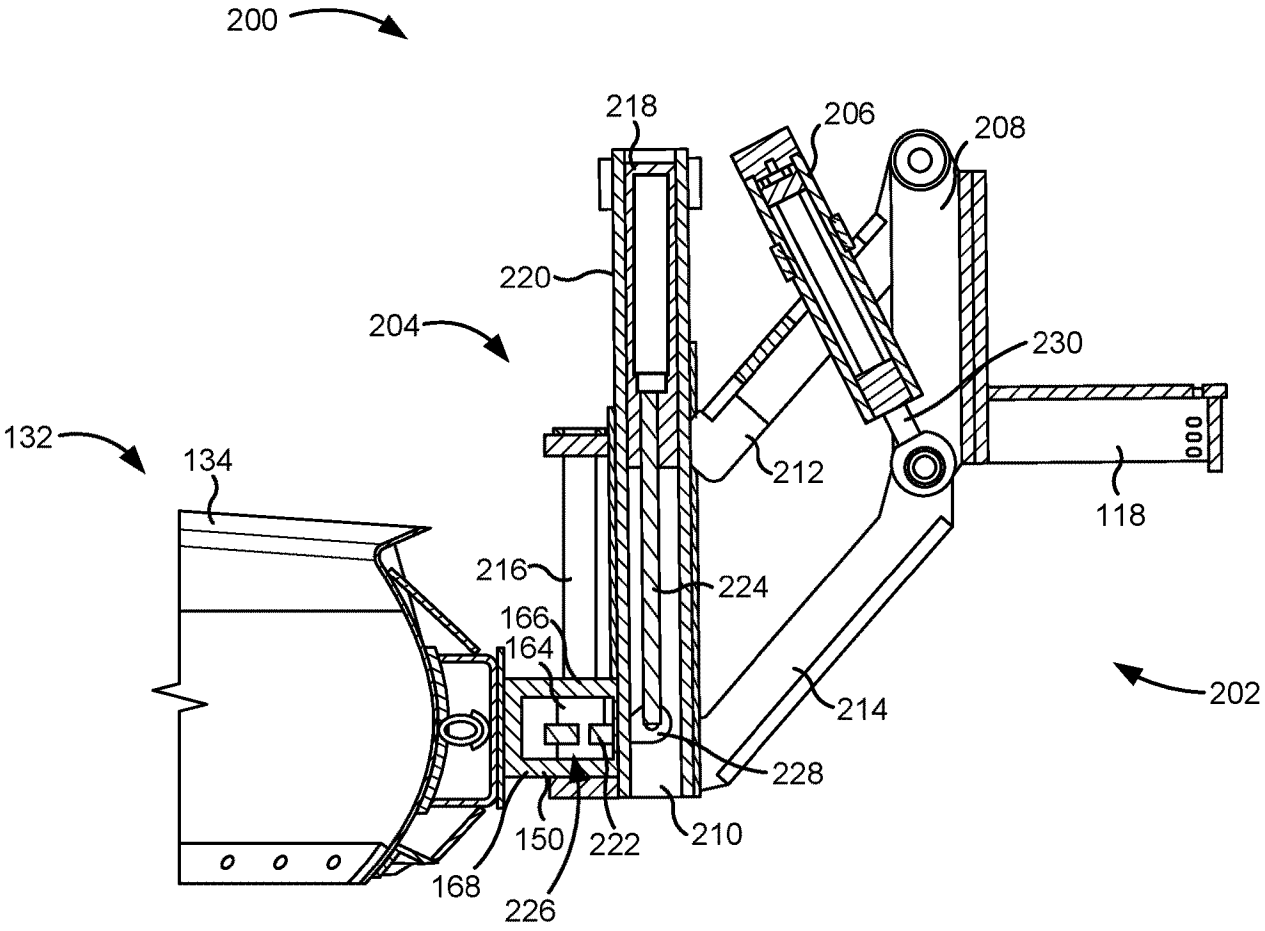
FIGS. 4-6 are perspective views of the lift assembly described herein at various positions of a lifting operation.
Figure 5:
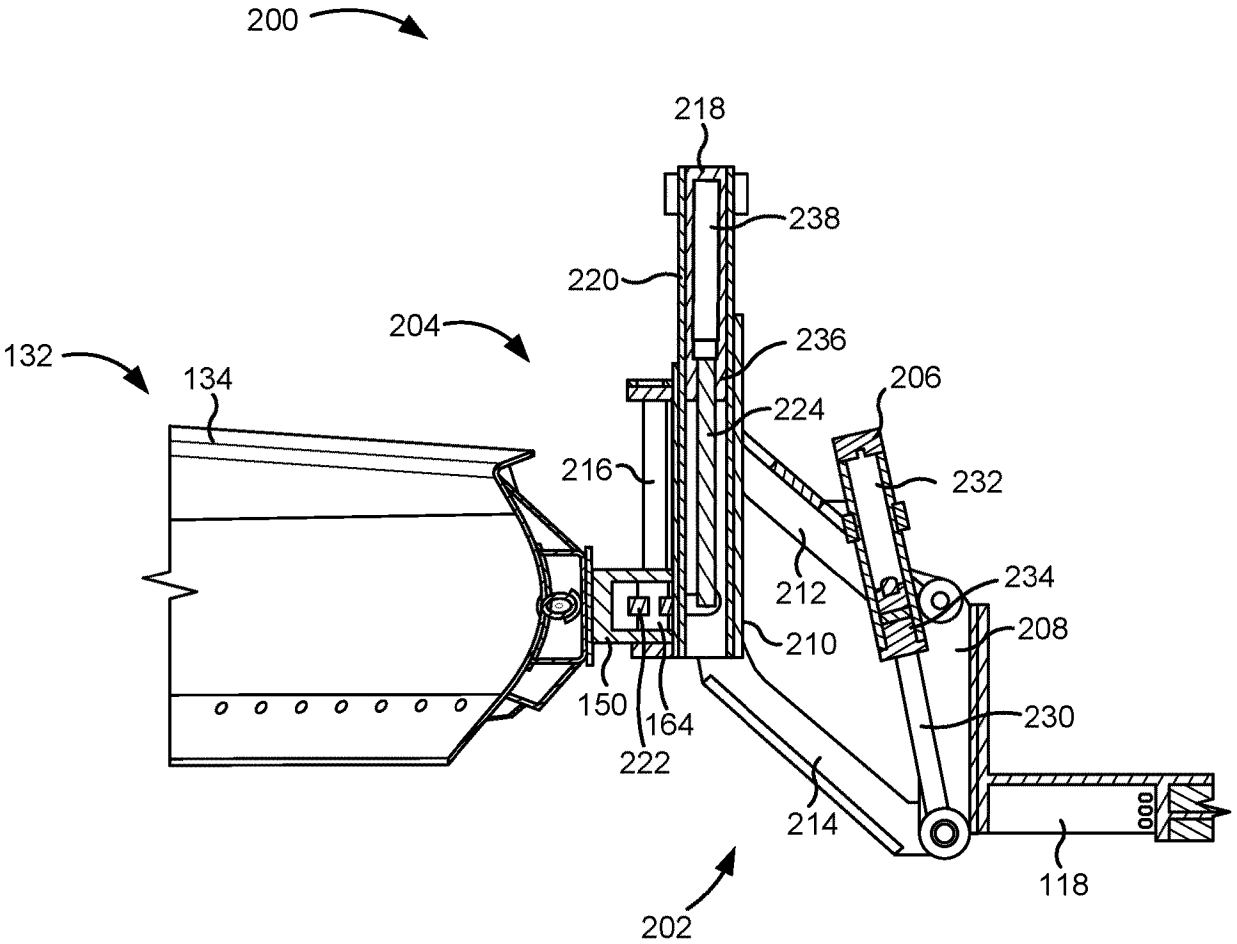
Figure 6:
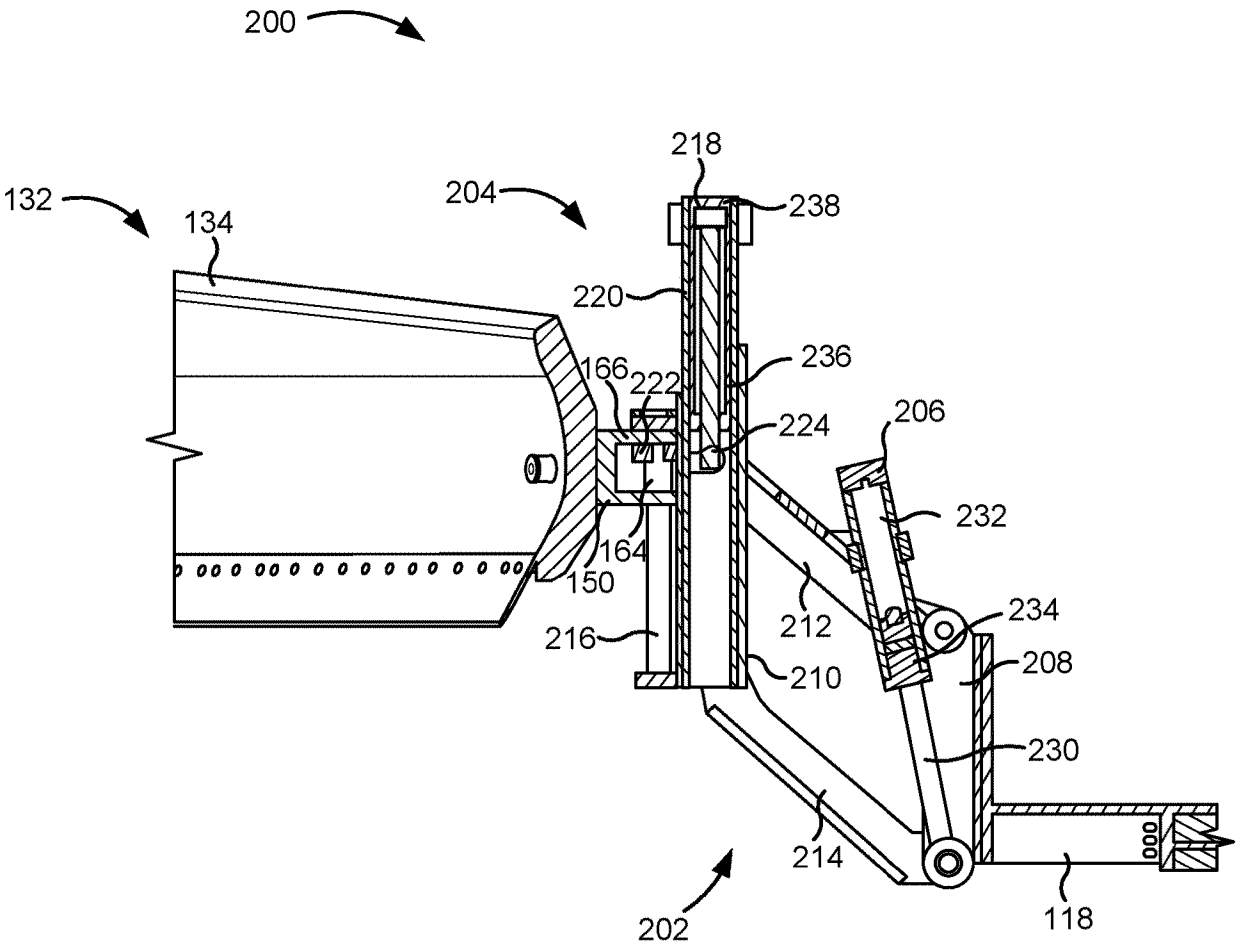

FIGS. 4-6 are perspective views of the lift assembly 200 described herein at various positions of a lifting operation. The hydraulic cylinder 206 may be mounted to the first vertical member 208 and the first horizontal member 212. For example, a head end of the hydraulic cylinder 206 may be coupled to the first horizontal member 212 and a rod end of the hydraulic cylinder 206 may be coupled to the first vertical member 208. The rod end of the hydraulic cylinder 206 may be coupled to a joint between the first vertical member 208 and the second horizontal member 214.

The hydraulic cylinder 206 may be configured to extend the rod of the hydraulic cylinder 206 to cause the second vertical member 210 to be raised (e.g., relative to the first vertical member 208 that is fixed to the undercarriage assembly of the motor grader 100) to cause the moldboard 134 to be raised the first portion 160 of the bench height 156. Similarly, the hydraulic cylinder 206 may be configured to retract the rod of the hydraulic cylinder 206 to cause the second vertical member 210 to be lowered (e.g., relative to the first vertical member 208 that is fixed to the undercarriage assembly of the motor grader 100) to cause the moldboard 134 to be lowered the first portion 160 of the bench height 156.

The second lifting mechanism 204 may include the hydraulic cylinder 218 (e.g., mounted approximately parallel relative to the bar 216) configured to slide the hinge 150 along the bar 216 to lift the moldboard 134 the second portion 162 of the bench height 156. The hydraulic cylinder 218 may be mounted inside a mast 220 of the second lifting mechanism 204. For example, a head end of the hydraulic cylinder 218 may be coupled to a top end of the mast 220 (e.g., via a pin or other means). A rod 224 of the hydraulic cylinder 218 may be coupled to the hinge 150 (e.g., to be configured to cause the hinge 150 to slide along the bar 216). The mast 220 may be positioned above the bar 216 and coupled to the second vertical member 210 of the first lifting mechanism 202. In other examples, the second lifting mechanism 204 may not include the mast 220. In such examples, the hydraulic cylinder 218 may be mounted at least partially within the second vertical member 210 of the first lifting mechanism 202 (e.g., of the four-bar linkage). For example, the hydraulic cylinder 218 may be mounted at least partially within the second vertical member 210 positioned behind the bar 216.

The hinge 150 may be slidably and rotatably coupled to the bar 216. For example, the hinge 150 may include a sleeve 164 that is disposed around the bar 216. The hinge 150 may be configured to slide up and down along the bar 216 (e.g., to raise and/or lower the moldboard 134 the second portion 162 of the bench height 156) and to rotate around the bar 216 (e.g., to rotate the moldboard 134 in the second rotational direction described above). The rod 224 of the hydraulic cylinder 218 may be coupled to the hinge 150. For example, in some cases, the hydraulic cylinder 218 may be configured to retract the rod 224 to cause the hinge 150 to slide up the bar 216 (e.g., to cause the moldboard 134 to raise the second portion 162 of the bench height 156). Similarly, the hydraulic cylinder 218 may be configured to extend the rod 224 to cause the hinge 150 to slide down the bar 216 (e.g., to cause the moldboard 134 to lower the second portion 162 of the bench height 156). In other examples, the hydraulic cylinder 218 may be configured to extend the rod 224 to cause the hinge 150 to slide up the bar 216, and to retract the rod 224 to cause the hinge 150 to slide down the bar 216.

The second lifting mechanism 204 may include a collar 222. The collar 222 may be disposed about (e.g., around) the hinge 150 (e.g., around the sleeve 164 of the hinge 150). For example, the collar 222 may be slidably mounted to the hinge 150 (e.g., around the sleeve 164). The collar 222 may be configured to raise and/or lower the hinge 150 by contacting the hinge 150. For example, the hinge 150 may include an upper plate 166 and a lower plate 168. The upper plate 170 and the lower plate 168 may be disposed at opposite ends of the sleeve 164.

To raise the hinge 150 along the bar 216, the collar 222 may be configured to contact the upper plate 166. In other words, the collar 222 may be configured to lift the hinge 150 along the bar 216 via contacting the upper plate 166. For example, the collar 222 may be coupled to a rod 224 of the hydraulic cylinder 218. As the hydraulic cylinder 218 actuates to move the rod 224, the collar 222 may in turn move to cause the hinge 150 to slide along the bar 216 (e.g., by contacting the upper plate 166 of the hinge 150).

FIG. 4 depicts the lift assembly 200 in a lowered position (e.g., when the moldboard 134 is at, or near, the ground or the work surface 104). As shown, there may be a gap 226 between the collar 222 and the lower plate 168 when the moldboard 134 is in the lowered position. In other words, the hinge 150 may be free to slide along bar 216 for some distance (e.g., defined by the gap 226) when the moldboard 134 is in the lowered position. This may enable a mechanical float feature for the moldboard 134 (e.g., may enable the moldboard 134 to freely move up and/or down a small distance to pass over objects contacted by the moldboard 134 along the work surface 104).

The collar 222 may be coupled to the rod 224. For example, the collar 222 may include a component 228 extending into the second vertical member 210 and/or the mast 220. The rod 224 may be coupled to the component 228. Therefore, as the rod 224 is extended and retracted via the hydraulic cylinder 218, the collar 222 may be moved up and down with the rod 224. When the rod 224 is retracted by the hydraulic cylinder 218, the collar 222 may be pulled up toward the hydraulic cylinder 218. As a result, the collar 222 may contact the upper plate 166 of the hinge 150. This may cause the hinge 150 to slide up the bar 216 toward the hydraulic cylinder 218 (e.g., thereby causing the moldboard 134 to be raised the second portion 162 of the bench height 156).

As the rod 224 is extended from the hydraulic cylinder 218, the collar 222 may be pushed away from the hydraulic cylinder 218. Therefore, the collar 222 may no longer contact the upper plate 170 of the hinge 150 and/or may contact the lower plate 168 of the hinge 150. This may cause the hinge 150 to slide down the bar 216 away from the hydraulic cylinder 218 (e.g., thereby causing the moldboard 134 to be lowered the second portion 162 of the bench height 156). When the hinge 150 reaches the bottom of the bar 216, there may be the gap 226 between the collar 222 and the lower plate 168 of the hinge 150. The moldboard 134 may be raised and/or lowered the first portion 160 of the bench height 156 via the first lifting mechanism in a similar manner as described elsewhere herein (e.g., via a four-bar linkage in which the second vertical member 210 is raised and/or lowered relative to the first vertical member 208).

A sequencing of the hydraulic cylinder 206 and the hydraulic cylinder 218 may be based on a design of a hydraulic circuit associated with the hydraulic cylinder 206 and the hydraulic cylinder 218 and/or relative sizes of the hydraulic cylinder 206 and the hydraulic cylinder 218. For example, a sequencing of the hydraulic cylinder 206 and the hydraulic cylinder 218 (e.g., to cause one of the cylinders to actuate first relative to the other cylinder) may be based on a plumbing design (e.g., whether the cylinders are plumbed in series or parallel) and/or one or more valves, such as a pressure relief valve, a diverter valve, and/or a bypass valve, among other examples, included in the hydraulic circuit. Additionally, or alternatively, the sequencing of the hydraulic cylinder 206 and the hydraulic cylinder 218 may be based on the relative sizes (e.g., volumes) of the hydraulic cylinder 206 and the hydraulic cylinder 218. For example, the hydraulic cylinder 206 may be larger (e.g., in volume) than the hydraulic cylinder 218 (e.g., because the hydraulic cylinder 206 may need to lift a combined weight of the first lifting mechanism 202, the second lifting mechanism 204, and the snow wing assembly 132, whereas the hydraulic cylinder 218 may only need to lift a combined weight of the second lifting mechanism 204 and the snow wing assembly 132). Therefore, the hydraulic cylinder 206 may actuate prior to the hydraulic cylinder 218 due to the size of the hydraulic cylinder 206 being larger than the hydraulic cylinder 218.

For example, a sequencing of the hydraulic cylinder 206 and the hydraulic cylinder 218 (e.g., to cause one of the cylinders to actuate first relative to the other cylinder) may be based on one or more valves or diverters included in a hydraulic circuit associated with the lift assembly 200. For example, the first lifting mechanism 202 (e.g., the four-bar linkage) may include the hydraulic cylinder 206 configured to lift the moldboard 134 the first portion 160 of the bench height 156 via the hydraulic cylinder 206. The second lifting mechanism 204 may include the hydraulic cylinder 218 configured to lift the moldboard 134 the second portion 162 of the bench height 156 via the hydraulic cylinder 218. The hydraulic cylinder 206 and the hydraulic cylinder 218 may be included in a hydraulic circuit (e.g., the same hydraulic circuit). The hydraulic circuit may include one or more valves or diverters configured to divert a flow of hydraulic fluid in the hydraulic circuit away from a first stage hydraulic cylinder (e.g., the hydraulic cylinder 206 or the hydraulic cylinder 218), and to a second stage hydraulic cylinder (e.g., the hydraulic cylinder 206 or the hydraulic cylinder 218) based on a pressure value associated with the first stage hydraulic cylinder (e.g., based on the pressure value satisfying a threshold).

"First stage" and "second stage" may refer to an order of sequencing of the hydraulic cylinders. For example, in a lifting or raising operation (e.g., where the moldboard 134 is raised from the work surface 104 to the bench height 156), the first stage hydraulic cylinder may be the hydraulic cylinder 206 and the second stage hydraulic cylinder may be the hydraulic cylinder 218. In a lowering operation (e.g., where the moldboard 134 is lowered from the bench height 156 to the work surface 104), the first stage hydraulic cylinder may be the hydraulic cylinder 218 and the second stage hydraulic cylinder may be the hydraulic cylinder 206.

As shown in FIG. 4, the lift assembly 200 may be in a lowered state (e.g., with the moldboard 134 lowered approximately to the work surface 104). For example, a rod 230 of the hydraulic cylinder 206 may be retracted to cause the second vertical member 210 of the four-bar linkage to lower relative to the first vertical member 208. Additionally, the rod 224 of the hydraulic cylinder 218 may be extended to enable the hinge 150 to slide down the bar 216. For example, fluid (e.g., hydraulic fluid) may be pumped into a rod end and/or out of a head end of the hydraulic cylinder 206 via the hydraulic circuit. Similarly, fluid (e.g., hydraulic fluid) may be pumped into a head end and/or out of a rod end of the hydraulic cylinder 218.

FIG. 5 depicts the lift assembly 200 having raised the moldboard 134 the first portion 160 of the bench height 156. For example, an operator of the motor grader 100 may provide a user input indicating that the moldboard 134 is to be raised. A controller (e.g., depicted in FIG. 7) may cause a pump of the hydraulic circuit to pump fluid (e.g., hydraulic fluid) through the hydraulic circuit. The controller may cause a directional control valve (e.g., depicted in FIG. 7) to adjust a directionality of the flow of the hydraulic circuit (e.g., to the hydraulic cylinder 206 and the hydraulic cylinder 218). For example, in a lifting operation, the controller may cause the hydraulic circuit to direct a flow of the fluid (e.g., hydraulic fluid) to a head end 232 of the hydraulic cylinder 206 and/or away from a rod end 234 of the hydraulic cylinder 206. This may cause the rod 230 of the hydraulic cylinder 206 to be extended, thereby causing the second vertical member 210 of the four-bar linkage to be raised relative to the first vertical member 208 (e.g., that is fixed to the motor grader 100). As a result, the moldboard 134 may be raised the first portion 160 of the bench height 156.

The hydraulic cylinder 206 and the hydraulic cylinder 218 may be plumbed in series (e.g., rather than in parallel). For example, the head end 232 of the hydraulic cylinder 206 may be plumbed in series with a rod end 236 of the hydraulic cylinder 218. Alternatively, the head end 232 of the hydraulic cylinder 206 may be plumbed in series with a head end 238 of the hydraulic cylinder 218 (e.g., in configurations in which the rod 224 of the hydraulic cylinder 218 is extended to raise the moldboard 134 the second portion 162 of the bench height 156). The plumbing line between the head end 232 of the hydraulic cylinder 206 and the rod end 236 of the hydraulic cylinder 218 may include a first valve 240 (e.g., depicted in FIG. 7). The first valve 240 may be a pressure relief valve, a bypass valve, a diverter valve, and/or a hydraulic fluid diverter, among other examples. The first valve 240 may be configured to prevent a flow of fluid (e.g., hydraulic fluid) to the rod end 236 of the hydraulic cylinder 218 until a pressure value associated with the plumbing line (e.g., associated with the head end 232 of the hydraulic cylinder 206) satisfies a threshold. In other words, the first valve 240 may prevent hydraulic fluid from flowing to the rod end 236 of the hydraulic cylinder 218 until the rod 230 of the hydraulic cylinder 206 is fully extended (e.g., to a maximum amount). This may ensure that in a lifting operation, the hydraulic cylinder 206 is the first stage hydraulic cylinder. Additionally, this may ensure that, during the lifting operation, the hydraulic cylinder 206 is enabled to complete an actuation of the rod 230 before the second lifting mechanism 204 (e.g., before the hydraulic cylinder 218) begins to lift the moldboard 134.

FIG. 6 depicts the lift assembly 200 having raised the moldboard 134 the second portion 162 of the bench height 156. For example, the operator of the motor grader 100 may continue to provide the user input indicating that the moldboard 134 is to be raised after the moldboard 134 reaches the first portion 160 of the bench height 156 (e.g., as depicted in FIG. 5). The controller (e.g., depicted in FIG. 7) may cause the pump of the hydraulic circuit to continue to pump fluid (e.g., hydraulic fluid) through the hydraulic circuit. Because the hydraulic cylinder 206 may be fully actuated (e.g., the rod 230 may be fully extended), as hydraulic fluid is continued to be pumped into the head end 232 of the hydraulic cylinder 206, pressure in the head end 232 and/or the plumbing line may increase. When the pressure value satisfies a threshold, the first valve 240 may be tripped or triggered and may cause the fluid (e.g., the hydraulic fluid) in the plumbing line to be diverted to the rod end 236 of the hydraulic cylinder 218.

As a result, hydraulic fluid may be pumped into the rod end 236 of the hydraulic cylinder 218 and/or out of the head end 238 of the hydraulic cylinder 218, thereby causing the rod 224 to be retracted. As the rod 224 is retracted, the hinge 150 may be pulled up the bar 216 to cause the moldboard 134 to be raised the second portion 162 of the bench height 156. For example, the collar 222 may contact the upper plate 166 of the hinge 150 as the rod 224 is retracted, thereby causing the hinge 150 to slide up the bar 216. As explained elsewhere herein, in other examples, the rod 224 may be extended to push the hinge 150 up the bar 216 if the hydraulic cylinder 218 is mounted in a different configuration than as shown in FIGS. 4-6.

In a lowering operation, the lift assembly 200 may include sequencing of the hydraulic cylinder in a similar manner as described above. For example, the hydraulic circuit may include a second valve 242 (e.g., depicted in FIG. 7) to control a sequencing of the lowering operation. For example, the head end 238 of the hydraulic cylinder 218 may be plumbed in series with the rod end 234 of the hydraulic cylinder 206 with the second valve 242 included in a plumbing line between the head end 238 of the hydraulic cylinder 218 and the rod end 234 of the hydraulic cylinder 206. For example, the controller may cause the directional control valve to switch a direction of flow of the hydraulic circuit such that fluid (e.g., hydraulic fluid) is first pumped into the head end 238 of the hydraulic cylinder 218. This may cause the rod 224 to be extended to cause the moldboard 134 to be lowered the second portion 162 of the bench height 156. Once the hydraulic cylinder 218 fully extends the rod 224, pressure inside the head end 238 of the hydraulic cylinder 218 may increase. When the pressure value satisfies a threshold, the second valve 242 may be tripped or triggered and may cause the fluid (e.g., the hydraulic fluid) to be diverted to the rod end 234 of the hydraulic cylinder 206. This may cause the rod 230 to be retracted, thereby causing the second vertical member 210 to be lowered relative to the first vertical member 208 of the four-bar linkage (e.g., causing the moldboard 134 to be lowered the first portion 160 of the bench height 156). As a result, the lift assembly 200 may have a controlled sequencing in the lowering operation to enable the hydraulic cylinder 218 to first lower the moldboard 134 the second portion 162 of the bench height 156 followed by the hydraulic cylinder 206 lowering the moldboard 134 the first portion 160 of the bench height 156 (e.g., after the hydraulic cylinder 218 lowers the moldboard 134 the entire second portion 162 of the bench height 156).

As indicated above, FIGS. 4-6 are provided as examples. Other examples may differ from what is described with regard to FIGS. 4-6.

Figure 7:
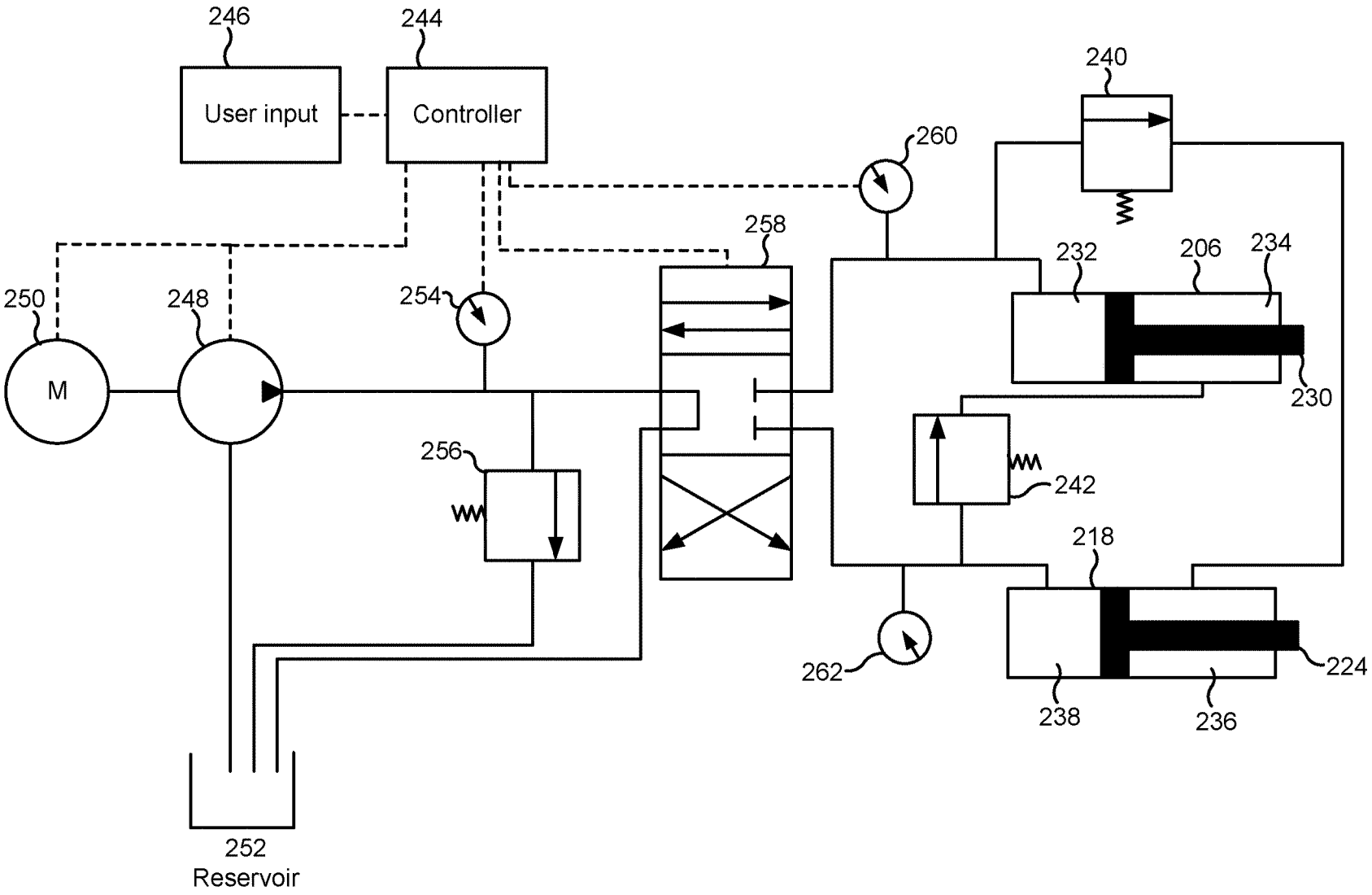
FIG. 7 is an example diagram of a hydraulic circuit as described herein.

FIG. 7 is an example diagram of a hydraulic circuit as described herein. As described above, the motor grader 100 may include a controller 244. The controller 244 may be a processor (e.g., coupled to a memory). The dashed lines shown in FIG. 7 from the controller 244 to other components depicted in FIG. 7 may depict communication links (e.g., wireless links and/or wired links). This is contrasted from the solid lines shown connecting the components shown in FIG. 7 (e.g., other than the controller 244), which may depict plumbing lines or fluid lines (e.g., fluid connections).

As shown in FIG. 7, the controller 244 may receive a user input 246. The user input 246 may be provided by an operator of the motor grader 100 (e.g., via a control or a control board included in the operator cab 122). The user input 246 may indicate whether the moldboard 134 is to be raised or lowered. The hydraulic circuit may include a pump 248. The pump 248 may be a hydraulic pump configured to pump fluid (e.g., hydraulic fluid) through the hydraulic circuit. In some examples, the pump 248 may be driven by a motor 250. The motor 250 may be an electric motor, an engine, or another system configured to drive or power the pump 248. When the controller 244 detects a user input 246 indicating that the moldboard 134 is to be raised or lowered, the controller 244 may cause the pump 248 and/or the motor 250 to activate (e.g., to cause fluid to be pumped through the hydraulic circuit). For example, the pump 248 may be configured to draw fluid (e.g., hydraulic fluid) from a reservoir 252 associated with the motor grader 100.

The hydraulic circuit may include a first pressure sensor 254. The first pressure sensor 254 may measure a pressure of the plumbing line of the hydraulic circuit. The first pressure sensor 254 may measure a system pressure for the hydraulic circuit. For example, if the pressure of the plumbing line proximate to the first pressure sensor 254 satisfies a threshold, a third valve 256 may be tripped or triggered to cause the fluid to be diverted to the reservoir 252. The third valve 256 may be a system pressure relief value to ensure that the pressure of the hydraulic circuit as a whole does not exceed the threshold. In some examples, the third valve 256 may be disposed prior to a directional control valve 258 of the hydraulic circuit.

The directional control valve 258 may control a direction of flow of the hydraulic circuit (e.g., to the hydraulic cylinder 206 and the hydraulic cylinder 218). The directional control valve 258 may be a two-way directional control valve, a three-way directional control valve, a four-way directional control valve, a check valve, a pilot operated valve, a manually actuated valve, a pilot actuated valve, a solenoid actuated valve, and/or a shuttle valve, among other examples. For example, for the lifting operation of the moldboard 134, the directional control valve 258 may be configured to cause fluid to be pumped to the hydraulic cylinder 206 (e.g., to the head end 232 of the hydraulic cylinder 206) and to return to the reservoir 252 from the hydraulic cylinder 218 (e.g., from the head end 238 of the hydraulic cylinder 218). For the lowering operation of the moldboard 134, the directional control valve 258 may be configured to cause fluid to be pumped to the hydraulic cylinder 218 (e.g., to the head end 238 of the hydraulic cylinder 218) and to return to the reservoir 252 from the hydraulic cylinder 206 (e.g., from the head end 232 of the hydraulic cylinder 218). In some examples, the controller 244 may cause the configuration of the directional control valve 258 to change based on whether the user input indicates that the moldboard 134 is to be raised or lowered.

For example, in the lifting operation, the directional control valve 258 may be configured to cause fluid (e.g., hydraulic fluid) to be pumped to the head end 232 of the hydraulic cylinder 206. In some implementations, a second pressure sensor 260 may measure a pressure value associated with the plumbing line and/or the head end 232 of the hydraulic cylinder 206. As fluid is pumped into the head end 232 of the hydraulic cylinder 206, the rod 230 of the hydraulic cylinder 206 may be extended. Additionally, fluid may be forced out of the rod end 234 of the hydraulic cylinder 206 (e.g., and back to the reservoir 252 via a line shown in FIG. 7 or another line not shown in FIG. 7). When the rod 230 of the hydraulic cylinder 206 is fully extended and fluid is continued to be pumped into the head end 232 of the hydraulic cylinder 206, pressure may increase in the plumbing line. When the pressure value satisfies a threshold (e.g., as measured by the second pressure sensor 260 and/or the first valve 240), the first valve 240 may be tripped to cause the fluid to be diverted to the hydraulic cylinder 218. The threshold may be a value associated with a pressure of the hydraulic cylinder 206 when the rod 230 is fully extended. For example, the first valve 240 may cause a plumbing line to the rod end 236 of the hydraulic cylinder 218 to be opened. As a result, fluid may be pumped into the rod end 236 of the hydraulic cylinder 218, thereby causing the rod 224 of the hydraulic cylinder 218 to be retracted. Additionally, fluid may be forced out of the head end 238 of the hydraulic cylinder 218 (e.g., and back to the reservoir 252 via a line shown in FIG. 7 or another line not shown in FIG. 7). When the rod 224 of the hydraulic cylinder 218 is fully retracted, pressure may continue to increase in the entire hydraulic circuit until the pressure satisfies a threshold that causes the third valve 256 to divert the flow of fluid to the reservoir 252. As a result, the lift assembly 200 may cause the moldboard 134 to be raised to the bench height 156 in a dual-stage, controlled manner.

In a lowering operation, the directional control valve 258 may be configured to cause fluid (e.g., hydraulic fluid) to be pumped to the head end 238 of the hydraulic cylinder 218. In some implementations, a third pressure sensor 262 may measure a pressure value associated with the plumbing line and/or the head end 238 of the hydraulic cylinder 218. As fluid is pumped into the head end 238 of the hydraulic cylinder 218, the rod 224 of the hydraulic cylinder 218 may be extended. Additionally, fluid may be forced out of the rod end 236 of the hydraulic cylinder 218 (e.g., and back to the reservoir 252 via a line shown in FIG. 7 or another line not shown in FIG. 7). When the rod 224 of the hydraulic cylinder 218 is fully extended and fluid is continued to be pumped into the head end 238 of the hydraulic cylinder 218, pressure may increase in the plumbing line. When the pressure value satisfies a threshold (e.g., as measured by the third pressure sensor 262 and/or the second valve 242), the second valve 242 may be tripped to cause the fluid to be diverted to the hydraulic cylinder 206. The threshold may be a value associated with a pressure of the hydraulic cylinder 218 when the rod 224 is fully extended. For example, the second valve 242 may cause a plumbing line to the rod end 236 of the hydraulic cylinder 218 to be opened. As a result, fluid may be pumped into the rod end 234 of the hydraulic cylinder 206, thereby causing the rod 230 of the hydraulic cylinder 206 to be retracted. Additionally, fluid may be forced out of the head end 232 of the hydraulic cylinder 206 (e.g., and back to the reservoir 252 via a line shown in FIG. 7 or another line not shown in FIG. 7). When the rod 230 of the hydraulic cylinder 206 is fully retracted, pressure may continue to increase in the entire hydraulic circuit until the pressure satisfies a threshold that causes the third valve 256 to divert the flow of fluid to the reservoir 252. As a result, the lift assembly 200 may cause the moldboard 134 to be lowered to the work surface 104 in a dual-stage, controlled manner.

In some implementations, the controller 244 may determine that the hydraulic fluid is to be diverted from a first stage hydraulic cylinder to a second stage hydraulic cylinder based on the pressure value associated with the first stage hydraulic cylinder satisfying a threshold (e.g., as measured by the second pressure sensor 260 or the third pressure sensor 262). The controller 244 may cause a hydraulic fluid diverter, of one or more hydraulic fluid diverters (e.g., first valve 240 or the second valve 242), to divert the flow of the hydraulic fluid to the second stage hydraulic cylinder. For example, the controller 244 may detect that the first stage hydraulic cylinder has moved the moldboard the first portion of the bench height based on the pressure value associated with the first stage hydraulic cylinder (e.g., the pressure value indicating that the first stage hydraulic cylinder has fully extended or retracted a rod of the first stage hydraulic cylinder). The controller 244 may cause (e.g., via the first valve 240 or the second valve 242) the hydraulic fluid of the hydraulic circuit to be diverted away from the first stage hydraulic cylinder and to the second stage hydraulic cylinder to cause the second stage hydraulic cylinder to move the moldboard a second portion of the bench height based on detecting that the first stage hydraulic cylinder has moved the moldboard the first portion of the bench height.

In some implementations, the hydraulic cylinder 206 and the hydraulic cylinder 218 may be associated with separate plumbing lines and/or separate hydraulic circuits. In such examples, the controller 244 may determine to switch a flow of hydraulic fluid and/or to activate or deactivate a given hydraulic circuit based on measuring the pressure value(s) of the hydraulic cylinder 206 and the hydraulic cylinder 218. For example, the controller 244 may measure the pressure values (e.g., via the second pressure sensor 260 and/or the third pressure sensor 262) and determine when to switch the flow of hydraulic fluid between the hydraulic cylinder 206 and the hydraulic cylinder 218 based on the measured pressure values.

As indicated above, FIG. 7 is provided as an example. Other examples may differ from what is described with regard to FIG. 7. For example, the hydraulic circuit depicted in FIG. 7 is provided as an example. In practice, the hydraulic circuit of the lift assembly 200 may include more components, fewer components, more plumbing lines, less plumbing lines, and/or differently arranged components as depicted in FIG. 7.

Figure 8:
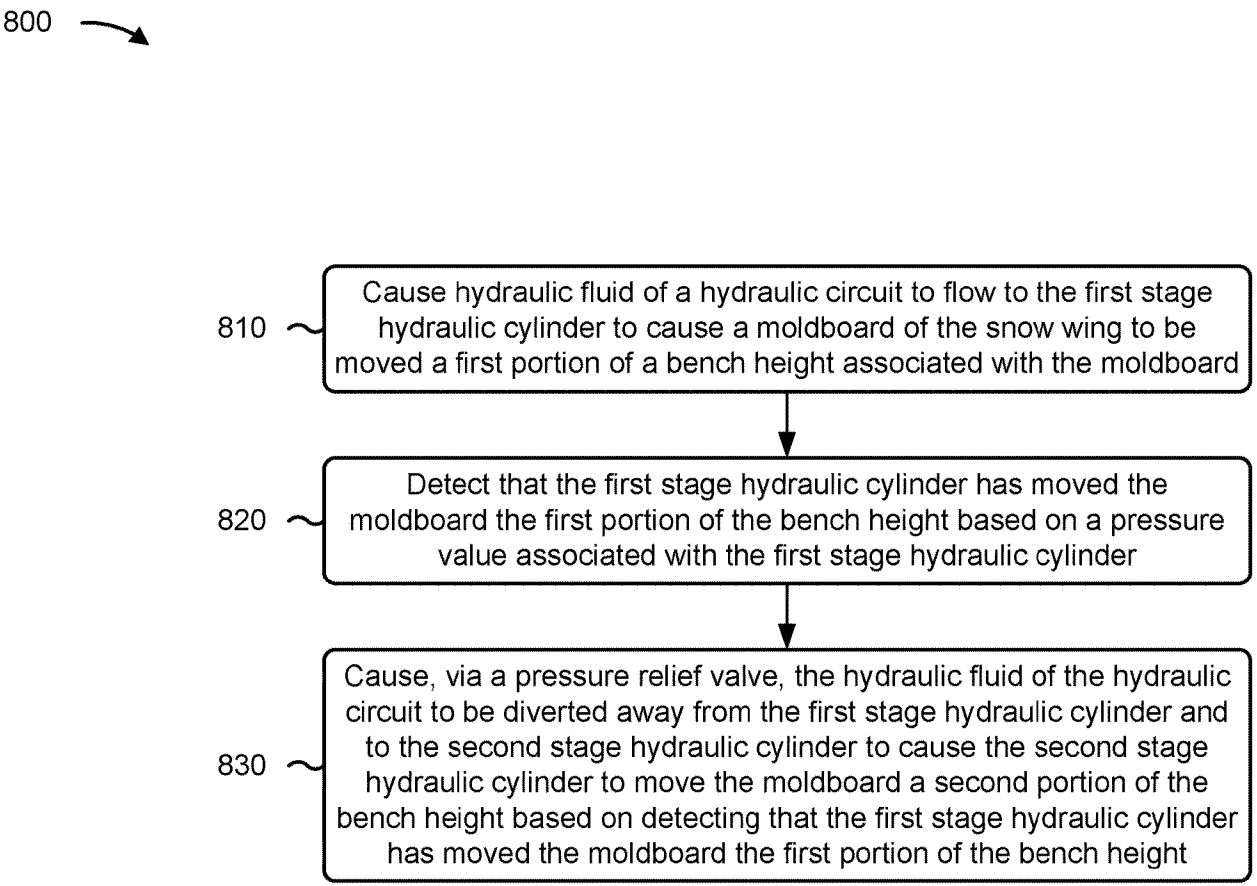
FIG. 8 is a flowchart of an example process associated with cylinder sequencing for a dual stage lift system for a snow wing.

FIG. 8 is a flowchart of an example process 800 associated with cylinder sequencing for a dual stage lift system for a snow wing. In some implementations, one or more process blocks of FIG. 8 may be performed by a controller (e.g., controller 244). In some implementations, one or more process blocks of FIG. 8 may be performed by another device or a group of devices separate from or including the controller, such as a valve (e.g., the first valve 240 or the second valve 242), and/or a sensor (e.g., the second pressure sensor 260 and/or the third pressure sensor 262). Additionally, or alternatively, one or more process blocks of FIG. 8 may be performed by one or more components, such as a processor, a memory, an input component, an output component, and/or a communication interface.

As shown in FIG. 8, process 800 may include causing hydraulic fluid of a hydraulic circuit to flow to the first stage hydraulic cylinder to cause a moldboard of the snow wing to be moved a first portion of a bench height associated with the moldboard (block 810). For example, the controller may cause hydraulic fluid of a hydraulic circuit to flow to the first stage hydraulic cylinder to cause a moldboard of the snow wing to be moved a first portion of a bench height associated with the moldboard, as described above. For example, the first stage hydraulic cylinder may be coupled to a four-bar linkage that is coupled to an undercarriage assembly of a motor grader and a second stage hydraulic cylinder may be coupled to an outboard link of the four-bar linkage for a raising operation of the moldboard. The first stage hydraulic cylinder and the second stage hydraulic cylinder may be plumbed in series in the hydraulic circuit.

As further shown in FIG. 8, process 800 may include detecting that the first stage hydraulic cylinder has moved the moldboard the first portion of the bench height based on a pressure value associated with the first stage hydraulic cylinder (block 820). For example, the controller may detect that the first stage hydraulic cylinder has moved the moldboard the first portion of the bench height based on a pressure value associated with the first stage hydraulic cylinder, as described above. For example, detecting that the first stage hydraulic cylinder has moved the moldboard the first portion of the bench height may be based on the pressure value associated with the first stage hydraulic cylinder satisfying a threshold.

As further shown in FIG. 8, process 800 may include causing, via a pressure relief valve, the hydraulic fluid of the hydraulic circuit to be diverted away from the first stage hydraulic cylinder and to the second stage hydraulic cylinder to cause the second stage hydraulic cylinder to move the moldboard a second portion of the bench height based on detecting that the first stage hydraulic cylinder has moved the moldboard the first portion of the bench height (block 830). For example, the controller may cause, via a pressure relief valve, the hydraulic fluid of the hydraulic circuit to be diverted away from the first stage hydraulic cylinder and to the second stage hydraulic cylinder to cause the second stage hydraulic cylinder to move the moldboard a second portion of the bench height based on detecting that the first stage hydraulic cylinder has moved the moldboard the first portion of the bench height, as described above.

For example, the hydraulic circuit may include a first pressure relief valve associated with a lifting operation of the moldboard and a second pressure relief valve associated with a lowering operation of the moldboard, and causing the hydraulic fluid of the hydraulic circuit to be diverted away from the first stage hydraulic cylinder and to the second stage hydraulic cylinder comprises causing, via the first pressure relief valve or the second pressure relief valve, the hydraulic fluid of the hydraulic circuit to be diverted away from the first stage hydraulic cylinder and to the second stage hydraulic cylinder based on whether a movement of the moldboard is associated with the lifting operation or the lowering operation.

Process 800 may include receiving a user input indicating that the moldboard is to be raised or lowered, wherein causing the hydraulic fluid of the hydraulic circuit to be diverted away from the first stage hydraulic cylinder and to the second stage hydraulic cylinder is based on the user input indicating that the moldboard is to be continued to be raised or lowered after the moldboard reaches the first portion of the bench height.

Although FIG. 8 shows example blocks of process 800, in some implementations, process 800 may include additional blocks, fewer blocks, different blocks, or differently arranged blocks than those depicted in FIG. 8. Additionally, or alternatively, two or more of the blocks of process 800 may be performed in parallel.

INDUSTRIAL APPLICABILITY

The lift assembly 200 of the motor grader 100 may utilize multiple cylinders (e.g., hydraulic cylinders) to raise and/or lower the moldboard 134 to the bench height 156. However, motor graders 100 may include various systems, components, or tools that utilize cylinders (e.g., hydraulic cylinders) or other hydraulic components, thereby limiting an available capacity for hydraulic circuits and/or input commands for controlling the hydraulic components. Therefore, the motor grader 100 may be unable to support multiple cylinders (e.g., hydraulic cylinders) and/or including multiple cylinders in a lift assembly 200 to raise and/or lower the moldboard 134 to a bench height 156 may result in the motor grader 100 being unable to support other hydraulic systems.

The lift assembly 200 described herein enables the use of multiple cylinders (e.g., the hydraulic cylinder 206 and the hydraulic cylinder 218) using the same hydraulic circuit or line, while also ensuring a correct and/or consistent sequencing of the multiple cylinders. For example, using the first valve 240 and/or the second valve 242 to sequence the hydraulic cylinder 206 and the hydraulic cylinder 218 may enable the lift assembly 200 to use a single hydraulic circuit and/or a single input command to control and/or sequence the lift assembly 200. This may allow for additional hydraulic systems and/or controls to be installed and/or included on the motor grader 100.

Ensuring a correct and/or consistent sequencing of the hydraulic cylinder 206 and the hydraulic cylinder 218 may enable the hydraulic cylinders to be appropriately sized. For example, if the lift assembly 200 were to rely only on a size of the hydraulic cylinders to control the sequencing, in some cases, material, such as snow, may be caked or stuck on the moldboard 134 and may change a weight distribution of the snow wing assembly 132 and/or the lift assembly 200. A change in the weight distribution may cause a change in the sequencing of the hydraulic cylinder 206 and the hydraulic cylinder 218 if the sequencing were to rely only on a size of the hydraulic cylinders to control the sequencing. Therefore, the valves described herein ensure a correct and/or consistent sequencing of the hydraulic cylinder 206 and the hydraulic cylinder 218 even in dynamic scenarios in which a weight distribution of the snow wing assembly 132 and/or the lift assembly 200 may change. For example, the hydraulic cylinder 206 may have a larger size (e.g., larger volume) than the hydraulic cylinder 218 because the hydraulic cylinder 206 needs to lift a combined weight of the first lifting mechanism 202, the second lifting mechanism 204, and the snow wing assembly 132 (e.g., whereas the hydraulic cylinder 218 may only need to lift a weight of the snow wing assembly 132). By ensuring the correct and/or consistent sequencing of the hydraulic cylinder 206 and the hydraulic cylinder 218, the lift assembly 200 may avoid scenarios in which the smaller sized hydraulic cylinder 218 is tasked with lifting a weight of the first lifting mechanism 202, the second lifting mechanism 204, and the snow wing assembly 132.

The foregoing disclosure provides illustration and description, but is not intended to be exhaustive or to limit the implementations to the precise forms disclosed. Modifications and variations may be made in light of the above disclosure or may be acquired from practice of the implementations. Furthermore, any of the implementations described herein may be combined unless the foregoing disclosure expressly provides a reason that one or more implementations cannot be combined. Even though particular combinations of features are recited in the claims and/or disclosed in the specification, these combinations are not intended to limit the disclosure of various implementations. Although each dependent claim listed below may directly depend on only one claim, the disclosure of various implementations includes each dependent claim in combination with every other claim in the claim set.

As used herein, "a," "an," and a "set" are intended to include one or more items, and may be used interchangeably with "one or more." Further, as used herein, the article "the" is intended to include one or more items referenced in connection with the article "the" and may be used interchangeably with "the one or more." Further, the phrase "based on" is intended to mean "based, at least in part, on" unless explicitly stated otherwise. Also, as used herein, the term "or" is intended to be inclusive when used in a series and may be used interchangeably with "and/or," unless explicitly stated otherwise (e.g., if used in combination with "either" or "only one of"). Further, spatially relative terms, such as "below," "lower," "above," "upper," and the like, may be used herein for ease of description to describe one element or feature's relationship to another element(s) or feature(s) as illustrated in the figures. The spatially relative terms are intended to encompass different orientations of the apparatus, device, and/or element in use or operation in addition to the orientation depicted in the figures. The apparatus may be otherwise oriented (rotated 90 degrees or at other orientations) and the spatially relative descriptors used herein may likewise be interpreted accordingly.

What is claimed is:

1. A lift assembly for a snow wing assembly of a motor grader, comprising:

a first lifting mechanism coupled to an undercarriage assembly of the motor grader, wherein the first lifting mechanism is configured to lift a moldboard of the snow wing assembly a first portion of a bench height associated with the moldboard via a first hydraulic cylinder;

a second lifting mechanism coupled to the first lifting mechanism and the moldboard, wherein the second lifting mechanism is configured to lift the moldboard of the snow wing assembly a second portion of the bench height via a second hydraulic cylinder, wherein the first hydraulic cylinder and the second hydraulic cylinder are included in a hydraulic circuit; and one or more valves included in the hydraulic circuit, configured to divert a flow of hydraulic fluid in the hydraulic circuit away from a first stage hydraulic cylinder, wherein the first stage hydraulic cylinder is one of the first hydraulic cylinder or the second hydraulic cylinder, and to a second stage hydraulic cylinder, wherein the second stage hydraulic cylinder is the other one of the first hydraulic cylinder or the second hydraulic cylinder, based on a pressure value associated with the first stage hydraulic cylinder satisfying a threshold.

2. The lift assembly of claim 1, wherein the first hydraulic cylinder and the second hydraulic cylinder are plumbed in series in the hydraulic circuit.

3. The lift assembly of claim 1, wherein the first lifting mechanism includes a four-bar linkage coupled to the undercarriage assembly of the motor grader; and wherein the second lifting mechanism includes a hinge slidably and rotatably coupled to a bar, wherein the hinge is coupled to the moldboard, wherein the bar is coupled to an outboard link of the four-bar linkage, and wherein the second hydraulic cylinder is configured to slide the hinge along the bar.

4. The lift assembly of claim 1, wherein a volume of the first hydraulic cylinder is greater than a volume of the second hydraulic cylinder.

5. The lift assembly of claim 1, wherein the first stage hydraulic cylinder is the first hydraulic cylinder and the second stage hydraulic cylinder is the second hydraulic cylinder for a lifting operation of the moldboard; and wherein the first stage hydraulic cylinder is the second hydraulic cylinder and the second stage hydraulic cylinder is the first hydraulic cylinder for a lowering operation of the moldboard.

6. The lift assembly of claim 1, wherein the one or more valves include a first valve for a lifting operation of the moldboard and a second valve for a lowering operation of the moldboard.

7. The lift assembly of claim 1, wherein the one or more valves include at least one of a pressure relief valve, or a bypass valve.

8. A motor grader, comprising:

a snow wing assembly, including a moldboard, mounted to the motor grader; and a lifting assembly for the snow wing assembly, configured to lift the moldboard to a bench height, wherein the lifting assembly is coupled to the motor grader and the snow wing assembly, and wherein the lifting assembly includes:

a four-bar linkage, coupled to the motor grader, including a first hydraulic cylinder that is configured to lift the moldboard a first portion of the bench height;

a lifting mechanism, coupled to an outboard link of the four-bar linkage, including a second hydraulic cylinder that is configured to lift the moldboard a second portion of the bench height, wherein the first hydraulic cylinder and the second hydraulic cylinder are included in a hydraulic circuit; and one or more hydraulic fluid diverters configured to divert a flow of hydraulic fluid in the hydraulic circuit away from a first stage hydraulic cylinder, wherein the first stage hydraulic cylinder is one of the first hydraulic cylinder or the second hydraulic cylinder, and to a second stage hydraulic cylinder, wherein the second stage hydraulic cylinder is the other one of the first hydraulic cylinder or the second hydraulic cylinder, based on a pressure value associated with the first stage hydraulic cylinder.

9. The motor grader of claim 8, wherein the lifting mechanism includes a hinge slidably coupled to a bar, wherein the hinge is coupled to the moldboard, and wherein the second hydraulic cylinder is configured to slide the hinge along the bar.

10. The motor grader of claim 8, wherein a first hydraulic fluid diverter, of the one or more hydraulic fluid diverters, is configured to enable the four-bar linkage to lift the moldboard the first portion of the bench height in a lifting operation based on the first hydraulic cylinder extending to a maximum amount associated with the first hydraulic cylinder; and to enable the lifting mechanism to lift the moldboard the second portion of the bench height after the four-bar linkage lifts the moldboard the first portion of the bench height based on diverting the flow of hydraulic fluid to the second hydraulic cylinder after the first hydraulic cylinder extends the maximum amount associated with the first hydraulic cylinder.

11. The motor grader of claim 8, wherein a first hydraulic fluid diverter, of the one or more hydraulic fluid diverters, is configured to enable the lifting mechanism to lower the moldboard the second portion of the bench height in a lowering operation based on the second hydraulic cylinder extending to a maximum amount associated with the second hydraulic cylinder; and to enable the four-bar linkage to lower the moldboard the first portion of the bench height after the lifting mechanism lowers the moldboard the second portion of the bench height based on diverting the flow of hydraulic fluid to the first hydraulic cylinder after the second hydraulic cylinder extends the maximum amount associated with the second hydraulic cylinder.

12. The motor grader of claim 8, wherein the one or more hydraulic fluid diverters include a first hydraulic fluid diverter for a lifting operation of the moldboard and a second hydraulic fluid diverter for a lowering operation of the moldboard.

13. The motor grader of claim 8, wherein the one or more hydraulic fluid diverters include at least one of: a valve, a pressure relief valve, a bypass valve, or a diverter valve.

14. The motor grader of claim 8, further comprising:

a controller configured to:

determine that the hydraulic fluid is to be diverted from the first stage hydraulic cylinder to the second stage hydraulic cylinder based on the pressure value associated with the first stage hydraulic cylinder satisfying a threshold; and cause a hydraulic fluid diverter, of the one or more hydraulic fluid diverters, to divert the flow of the hydraulic fluid to the second stage hydraulic cylinder.

15. A method for sequencing a first stage hydraulic cylinder and a second stage hydraulic cylinder of a lifting assembly of a snow wing, comprising:

causing hydraulic fluid of a hydraulic circuit to flow to the first stage hydraulic cylinder to cause a moldboard of the snow wing to be moved a first portion of a bench height associated with the moldboard;

detecting that the first stage hydraulic cylinder has moved the moldboard the first portion of the bench height based on a pressure value associated with the first stage hydraulic cylinder; and causing, via a pressure relief valve, the hydraulic fluid of the hydraulic circuit to be diverted away from the first stage hydraulic cylinder and to the second stage hydraulic cylinder to cause the second stage hydraulic cylinder to move the moldboard a second portion of the bench height based on detecting that the first stage hydraulic cylinder has moved the moldboard the first portion of the bench height.

16. The method of claim 15, wherein the first stage hydraulic cylinder is coupled to a four-bar linkage that is coupled to an undercarriage assembly of a motor grader and the second stage hydraulic cylinder is coupled to an outboard link of the four-bar linkage for a raising operation of the moldboard.

17. The method of claim 15, wherein the first stage hydraulic cylinder and the second stage hydraulic cylinder are plumbed in series in the hydraulic circuit.

18. The method of claim 15, wherein the hydraulic circuit includes a first pressure relief valve associated with a lifting operation of the moldboard and a second pressure relief valve associated with a lowering operation of the moldboard, and wherein causing the hydraulic fluid of the hydraulic circuit to be diverted away from the first stage hydraulic cylinder and to the second stage hydraulic cylinder comprises:

causing, via the first pressure relief valve or the second pressure relief valve, the hydraulic fluid of the hydraulic circuit to be diverted away from the first stage hydraulic cylinder and to the second stage hydraulic cylinder based on whether a movement of the moldboard is associated with the lifting operation or the lowering operation.

19. The method of claim 15, further comprising:

receiving a user input indicating that the moldboard is to be raised or lowered, wherein causing the hydraulic fluid of the hydraulic circuit to be diverted away from the first stage hydraulic cylinder and to the second stage hydraulic cylinder is based on the user input indicating that the moldboard is to be continued to be raised or lowered after the moldboard reaches the first portion of the bench height.

20. The method of claim 15, wherein detecting that the first stage hydraulic cylinder has moved the moldboard the first portion of the bench height is based on the pressure value associated with the first stage hydraulic cylinder satisfying a threshold.

* * * * *